US006659672B1

(12) United States Patent
Kirita

(10) Patent No.: US 6,659,672 B1
(45) Date of Patent: Dec. 9, 2003

(54) WRITING IMPLEMENT

(75) Inventor: Kazuhisa Kirita, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/701,813

(22) PCT Filed: Jun. 2, 1999

(86) PCT No.: PCT/JP99/02946

§ 371 (c)(1),
(2), (4) Date: Dec. 1, 2000

(87) PCT Pub. No.: WO99/62726

PCT Pub. Date: Dec. 9, 1999

(30) Foreign Application Priority Data

Jun. 2, 1998 (JP) ..... 10-167807

(51) Int. Cl.[7] ..... B43K 5/00; B43K 8/08; B43M 11/06

(52) U.S. Cl. ..... 401/199; 401/23; 401/192; 401/198

(58) Field of Search ..... 401/192, 193, 401/195, 196, 198, 199, 207, 23

(56) References Cited

U.S. PATENT DOCUMENTS 4,016,414 A * 4/1977 Browning et al. ..... 401/192
4,037,976 A * 7/1977 McDaniel et al. ..... 401/198
4,749,618 A * 6/1988 Kawaguchi et al. ..... 401/199
5,547,499 A * 8/1996 Kawasumi et al. ..... 106/31.25
5,678,939 A * 10/1997 Ross ..... 401/192

FOREIGN PATENT DOCUMENTS

| | | |
|---|---|---|
| JP | 51427 | 7/1973 |
| JP | 115023 | 10/1974 |
| JP | 33731 | 3/1979 |
| JP | 140485 | 10/1981 |
| JP | 60186573 | 9/1985 |
| JP | 302096 | 12/1988 |
| JP | 29390 | 3/1991 |
| JP | 05271602 | 10/1993 |
| JP | 06009916 | 1/1994 |
| JP | 052486 | 2/1995 |
| JP | 08048930 | 2/1996 |
| JP | 207486 | 8/1997 |

* cited by examiner

*Primary Examiner*—Tuan N. Nguyen
(74) *Attorney, Agent, or Firm*—Darby & Darby

(57) ABSTRACT

A writing implement is provided and includes a pen element that feeds and retain ink from a writing implement body. The pen element has an ink leader, a writing part delivering ink from the ink leader portion and a viewer portion directly above with respect to the axial direction of the writing part allowing observation of the view in the writing direction. The present writing implement therefore allows easy observation of the view on the opposite side of the pen element as the pen point and allows the end point of the drawn line to be readily distinguished.

11 Claims, 17 Drawing Sheets

(a)

(b)

WRITING IMPLEMENT

TECHNICAL FIELD

The present invention relates to a writing implement or the like which has a pen element that feeds and retains ink from the writing implement body, and more detailedly, the present invention is generally directed to liquid writing implements and the like of types which are referred to as paint markers, oil-based markers, water-based markers and high lighter pens.

BACKGROUND ART

Conventionally known liquid writing implements and the like in which ink is fed from the writing implement body to the pen element as a pen point, include: for example, 1) writing implement having an ink absorbing element for retaining ink, connected to the rear end of the pen point; 2) writing implement in which a valve structure is provided between the pen point and the ink chamber and the valve structure is released when the pen point is moved whilst being pressed; 3) writing implement having a valve structure which is released by clicking the rear end; 4) writing implement in which a plug element and valve element advancing fluid-tightly is arranged in the ink chamber and ink is fed when the valve element is slightly released by negative pressure arising during writing; and 5) writing implement having ink retainer (collector member) with many fins provided between the pen point and the ink chamber.

Nevertheless, when a line having a large line width is drawn from the left to right by the right hand using any of these liquid writing implements and others, the pen element as the pen point is thick so that the right side of the pen element is kept out of view, causing inconvenience in distinguishing the right end of the drawn line.

This is quite true when a table is drawn by ruling on simili paper etc., or when characters of a horizontally written article are traced by a highlighter pen etc. In order to deal with this inconvenience, some may draw a line from the right to left others may draw lines holding the writing implement in an awkward manner, as shown in FIG. 22(*a*). However, since these are not the natural way of using a writing implement, the user will feel uncomfortableness and will receive an oppressive burden on the fingers. FIG. 22(*b*) shows the natural way of gripping a pen while writing.

The problem of inconvenience arising when designating the right end of a line is liable to occur more markedly with a pen having a writing point that produces drawn lines of 2 mm wide or more. Though the above problem is unlikely to occur when drawing at a writing angle of 45 degrees or smaller, writing at a small writing angle will cause difficulties when writing near the user's body. This difficulty is more marked especially when the pen is used in a relatively narrow space such as in the train, airplane and the like. The above difficulties cannot be simply attributed to the shape of the writing point.

The similar problems occur with a pen of a type shown in FIG. 23 (e.g., Japanese Utility Model Application Laid-Open Sho 56 No. 140485) where a writing implement 3 has a pen tip 1 bent with respect to a barrel 2. That is, with a large writing angle, the opposite side of the pen cannot be seen, whereas with a small writing angle, writing is difficult in some configurations near the user's body through the other side can be seen.

With a calligraphic-brush pen as well as a writing implement having a flexible pen tip with its thickness variable as shown in Japanese Utility Model Application Laid Open Sho 54 No. 33731, if more than a certain degree of writing load is applied, the other side of the pen can be seen, but there is a drawback in that lines with a constant drawn line width cannot be obtained.

Further, among the writing implements having a split pen point with an ink guide slit such as fountain pens, various types of pens having a bent pen point have been known as in disclosed by Japanese Utility Model Application Laid-Open Sho 48 No. 51427, Japanese Utility Model Application Laid-Open Sho 49 No. 15023, Japanese Utility Model Application Laid-Open Hei 3 No. 29390 and Japanese Patent Application Laid-Open Hei 9 No. 52486. However, the main object of these writing implements is to vary the width of drawn lines like the aforementioned calligraphic-brush pen. A writing implement of an open-V shape has the same drawbacks as writing implement 3 with pen tip 1 and barrel 2 bent, shown in FIG. 23. Since the writing angle of the split pen point is constrained not only with respect to the pen tip direction but also to the lateral direction, a pen of this type is not suitable for drawing lines.

It is therefore an object of the present invention to provide a writing implement which has a pen element that feeds and retains ink from the writing implement body and allows easy observation of the view of the opposite side of the pen element as the pen point and easy distinction of the end point of a drawn line.

DISCLOSURE OF THE INVENTION

In view of the above conventional problems and in order to solve these problems, the present inventors have found that the aimed writing implement having a pen element that feeds and retains ink from the writing implement body can be obtained by configuring the pen element with a specific structure, thus completing the present invention.

Specifically, the present invention has the following features (1) to (8).

A (1) writing implement having a pen element that feeds and retains ink from the writing implement body, characterized in that the pen element comprises: an ink leader portion; a writing part delivering ink from the ink leader portion; and a viewer portion disposed directly above with respect to the axial direction of the writing part allowing observation of the view in the writing direction.

(2) The writing implement defined as above in (1), wherein the writing part of the pen element renders drawn lines of 2 mm or wider.

(4) The writing implement defined as above in (1) or (2), wherein the ink leader portion and writing part of the pen element is formed of a one-piece porous member.

(5) The writing implement defined as above in (1) or (2), wherein the pen element further comprises a support member for supporting the ink leader portion and writing part, and at least part of the support member allows observation of the view in the writing direction, providing the function of the viewer portion.

(7) The writing implement defined as above in (1), wherein the viewer portion is formed of a lens member.

(8) The writing implement defined as above in (1), wherein the ink contains a fluorescent color additive.

BRIEF DESCRIPTION OF THE DRAWINGS

FIG. 18(*c*) is a sectional view when a cover is attached.

FIG. 2(*b*) is a perspective view showing a case where a pen is held in a normal manner.

BEST MODE FOR CARRYING OUT THE INVENTION

In order to describe the present invention more detailedly, the invention will be described with reference to the accompanying drawings.

Figure 1:
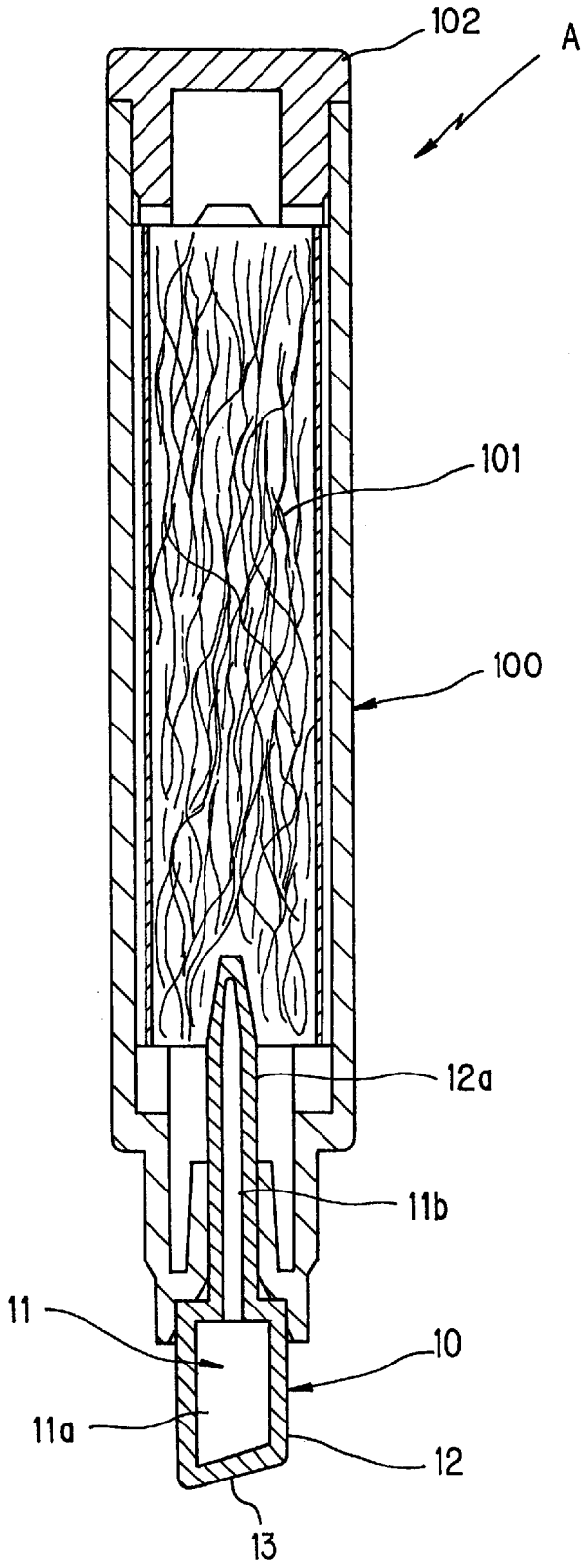
FIG. 1 is a vertical sectional view showing an embodiment A of a writing implement of the present invention.
Figure 7:
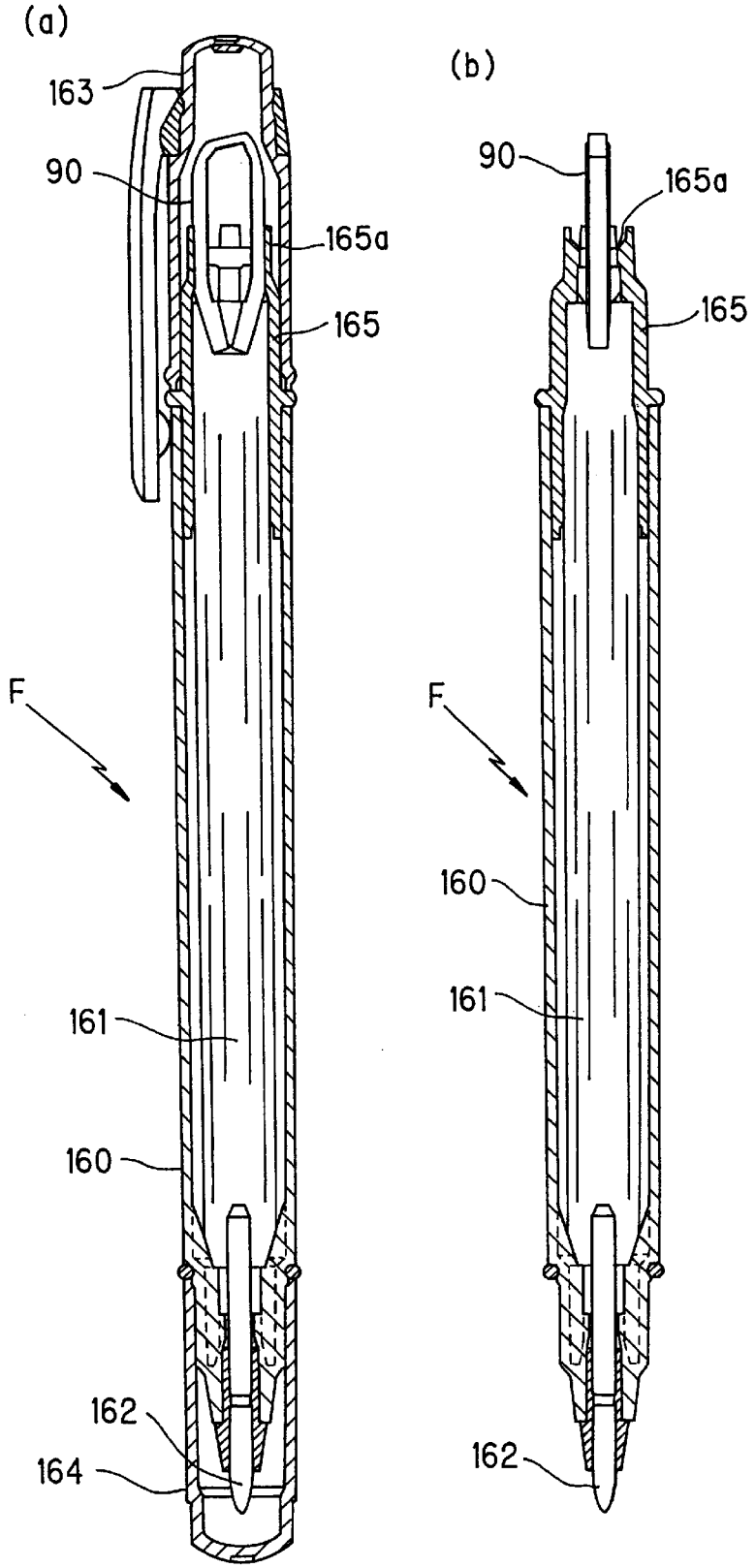
FIGS. 7(*a*) and 7(*b*) are a vertical sectional view and sectional side view, respectively, showing an embodiment F of a writing implement of the present invention.

Modes for carrying out the present invention are described detailedly with reference to the accompanying drawings as follows. FIGS. 1 and 7 show a variety of embodiments of writing implements having a pen element as an essential feature of the present invention. These embodiments are basically usual writing implements except in their pen elements and will be described briefly.

FIG. 1 is an embodiment of a writing implement A wherein a barrel cylinder 100 as the writing implement body incorporates an ink absorbing element 101 for absorbing ink. This writing implement A has an ink absorbing element 101 connected to the rear end of a pen element 10 so as to supply ink element 10 with ink from ink absorbing element 101. In this figure, a reference numeral 102 designates a tail plug.

Figure 2:
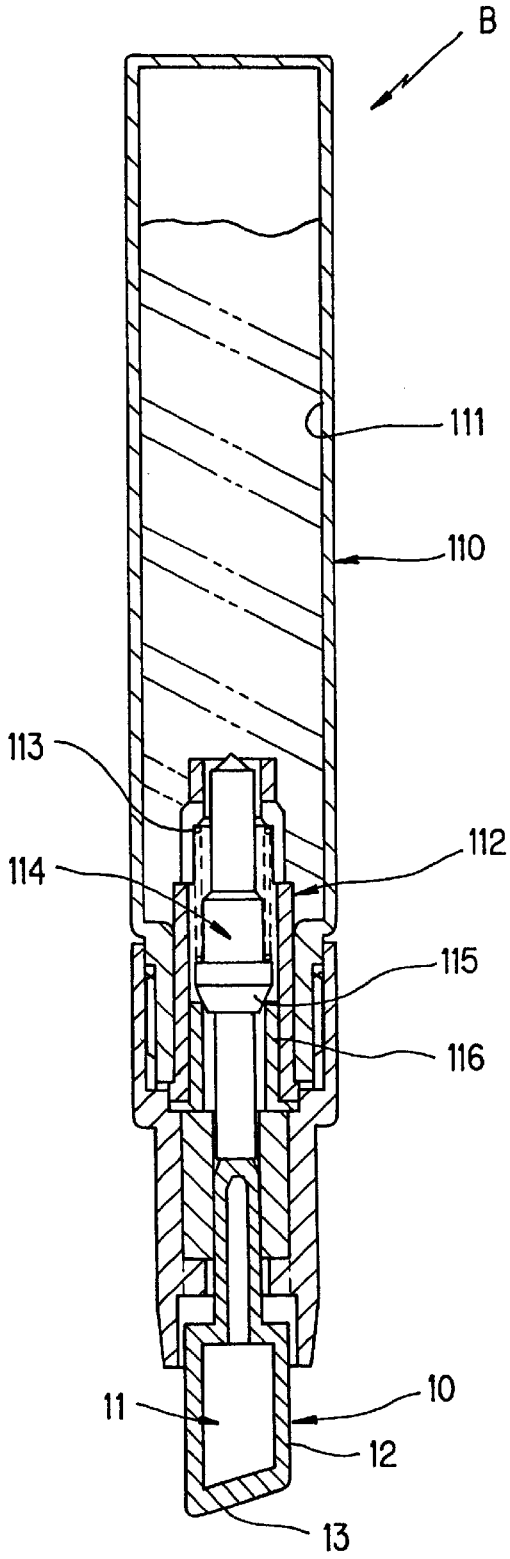
FIG. 2 is a vertical sectional view showing an embodiment B of a writing implement of the present invention.

FIG. 2 shows an embodiment of a writing implement B of a type having a valve mechanism. This writing implement B has a valve mechanism 112 between a pen element 10 and an ink chamber 111 of a barrel cylinder 110 forming the writing implement body. As the pen tip is moved by pressing, a valve rod 114 is moved rearwards against the urging force of a spring 113 so as to release a valve 115 and deliver the ink out. When ink has a high viscosity or when ink contains sedimentous components, an agitation ball (not shown) may be provided inside ink chamber 111. In this figure, a reference numeral 116 designates a valve seat.

Figure 3:
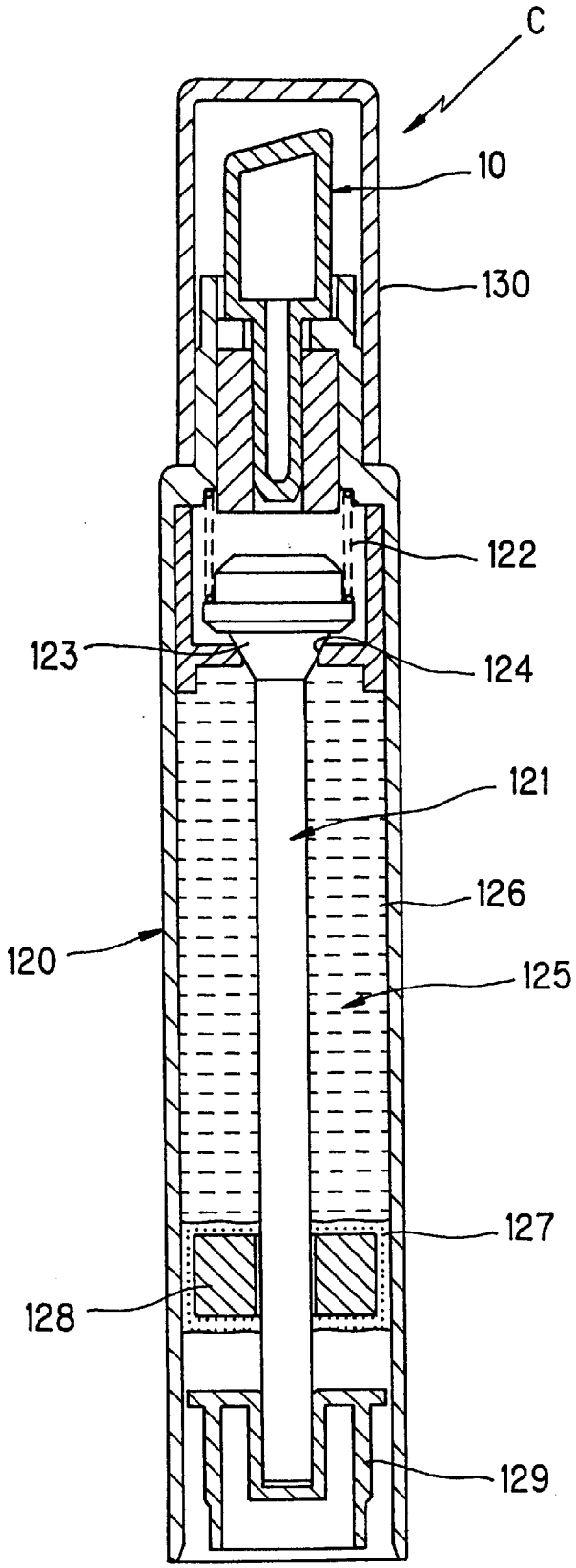
FIG. 3 is a vertical sectional view showing an embodiment C of a writing implement of the present invention when it is unused.
Figure 4:
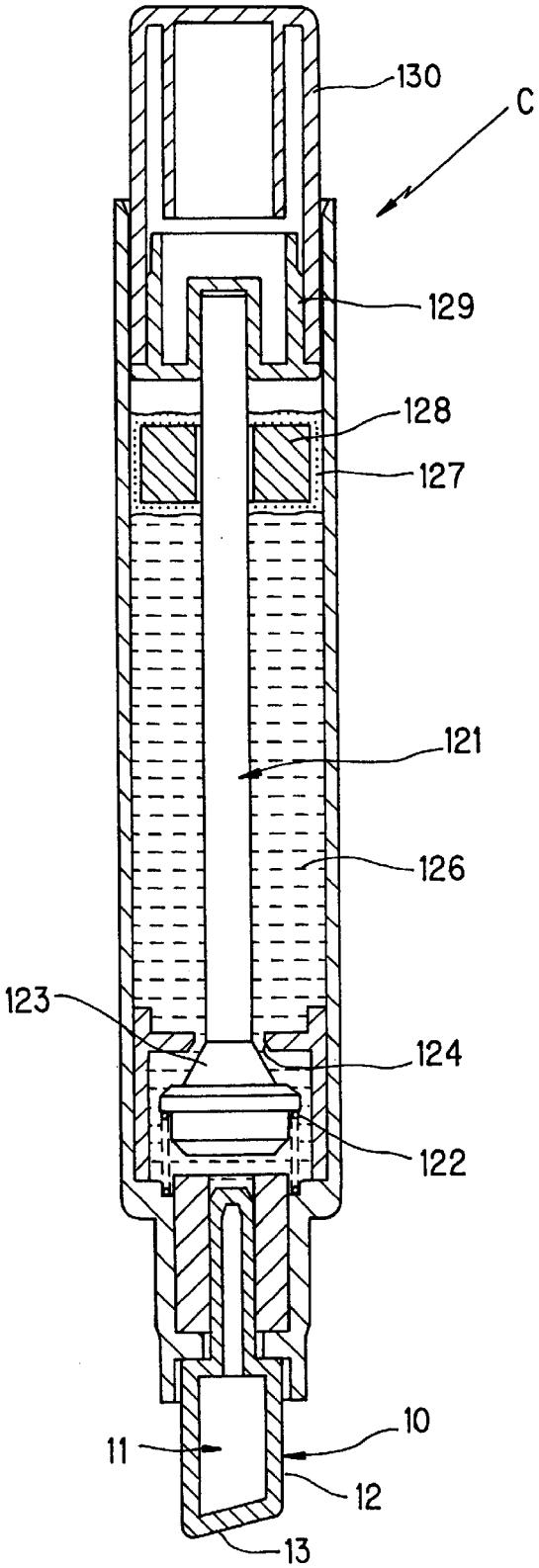
FIG. 4 is a vertical sectional view showing writing implement C of FIG. 3 when it is being used.

FIGS. 3 and 4 show an embodiment of a writing implement C of a type having another valve mechanism. Writing implement C has a valve rod 121 urged by a spring 122 inside a barrel cylinder 120 forming the writing implement body with its valve 123 placed in hermetic contact with a valve seat 124 while ink 126 fills an ink chamber 125 in the rear of valve 123. Further, disposed at the rear end of ink 126 is a follower 127 of a greasy material for preventing evaporation and back leakage of ink as well as moving along with the consumption of ink, with a resin-made plug element 128 having almost the same specific weight as the follower, immersed in follower 127. Valve rod 121 is arranged passing through follower 127 while a tail plug 129 is fixed to the rear end of valve rod 121.

As shown in FIG. 4, in writing implement C of this embodiment, a cap 130 for sealing a pen element 10 is fitted to tail plug 129. When the rear end of the cap is clicked, the hermetic contact between valve 123 and valve seat 124 is released so as to allow ink 126 to fill pen element 10.

Figure 5:
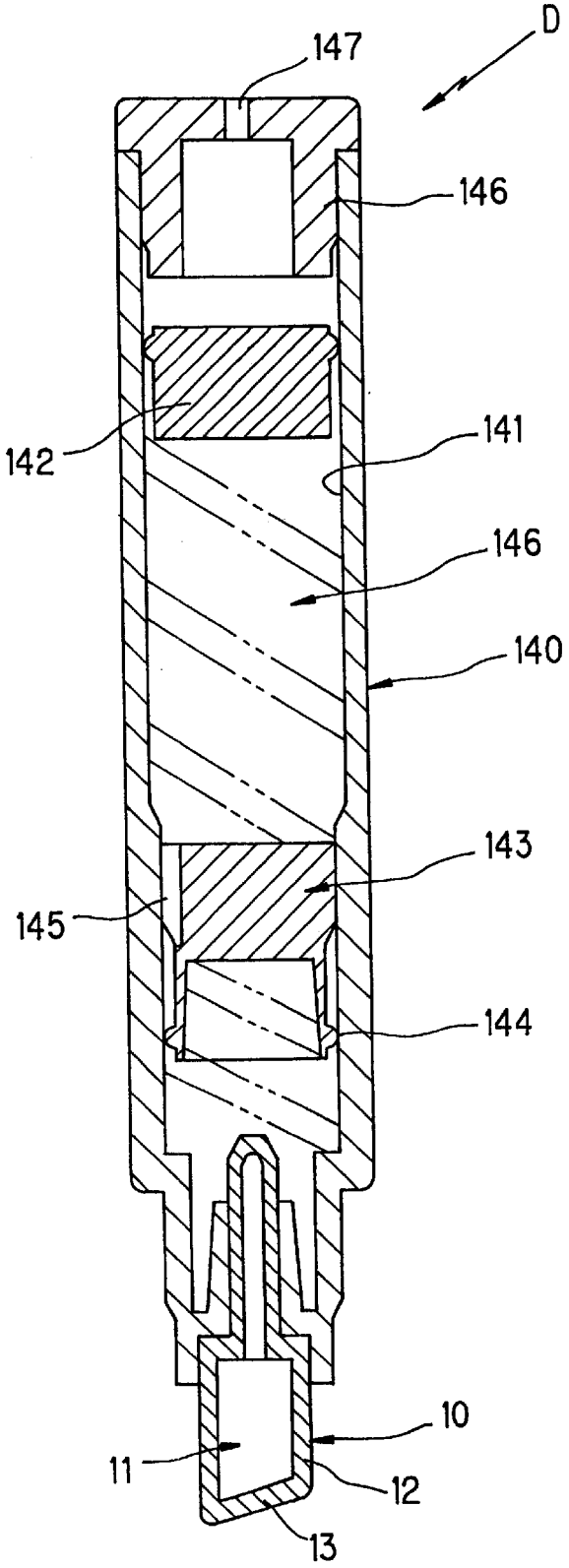
FIG. 5 is a vertical sectional view showing an embodiment D of a writing implement of the present invention.

FIG. 5 shows an embodiment of a writing implement D of a type having another valve mechanism. This writing implement D includes a valve element 143 and plug element 142 advancing fluid-tightly with respect to an ink chamber 141 inside a barrel cylinder 140 as a writing implement body. As a negative pressure arises while writing, a valve portion 144 which is formed in valve element 143 and put in hermetic contact with the wall surface of ink chamber 141 slightly deforms to create a gap, whereby ink 146 is fed through a channel 145 to a pen element 10 arranged in the front. Here, the above plug element 142 and valve element 143 are made up of an elastic material such as silicone rubber and the like. In the figure, reference numerals 146 and 147 designate a tail plug and a vent, respectively.

Figure 6:
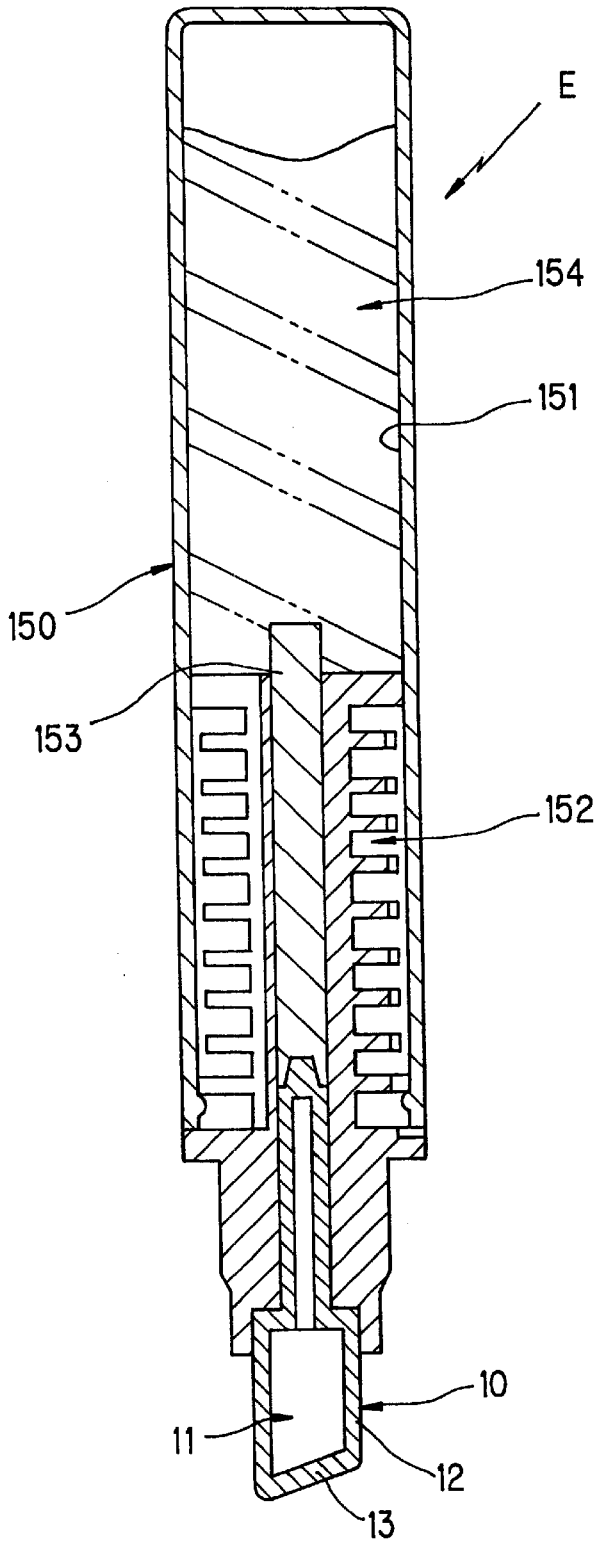
FIG. 6 is a vertical sectional view showing an embodiment E of a writing implement of the present invention.

FIG. 6 shows an embodiment of a writing implement E of a type having an ink retainer (collector element). In this writing implement E, an ink retainer 152 having many fins arranged between a pen element 10 and an ink chamber 151 is disposed inside a barrel cylinder 150 that forms the writing implement body. An ink leader core 153 is disposed in the center of the barrel so that ink 154 will be fed to pen element 10.

FIGS. 7(*a*) and 7(*b*) show an embodiment of a writing implement F of a type in which an ink absorbing element 161 filled up with ink is arranged in a barrel cylinder 160 forming the writing implement body while a pen element 162 for this lines and a tip pen element 90 for thick lines (having a different pen element shape from that shown in FIG. 1, etc.) are arranged at both ends. In this writing implement F, the rear ends of pen element 90 for thick lines and pen element 162 for thin lines are joined to ink absorbing element 161 so as to feed pen elements 90 and 162 with ink from ink absorbing element 161. In this figure, reference numerals 163 and 164 designate caps. Designated at 165 is a rear barrel, to which pen element 90 (pen element 90 shown in detail in FIGS. 19 to 21) is attached.

Figure 8:
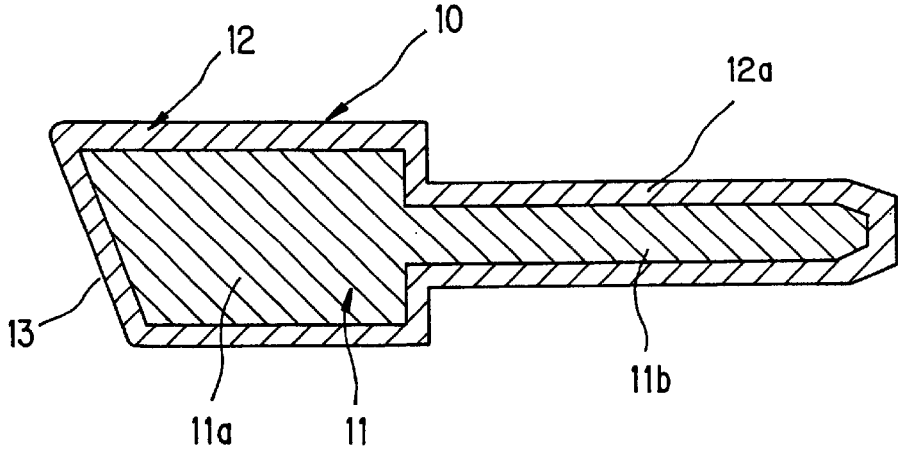
FIG. 8 is a sectional view showing the first embodiment of a pen element as an essential feature of the present invention.

FIG. 8 shows the first embodiment of a pen element as an essential feature of the writing implement of the present invention. This pen element is used for the above described writing implements of embodiments A to E.

Pen element 10 of the first embodiment is configured so that the outer periphery of a support member 11 is covered with an ink leader portion 12. Support member 11 is formed of transparent resin, glass or the like that allows observation of the view in the writing direction. Specifically, this support member (this may be also referred to hereinbelow as transparent support member) is made up of transparent resin, glass or the like having a parallel transmittance of 30% or greater, preferably having a parallel transmittance of 50% or greater, more preferably having a parallel transmittance of 70% or greater and is composed of a viewer portion 11*a* having wide smooth surfaces arranged in the front and a shank portion 11*b* in the rear. If this member is made up of resin, glass or the like having a parallel transmittance of not more than 30%, it is not possible to provide a clear view in the writing direction, an undesirable result. Examples of resin and the like having this physical property include styrene-isoprene resin, ionomer resin, SBR-PP blend resin, acrylic resin, nylon resin and polymethyl pentene.

Ink leader portion 12 may be of a polymer foamed material such as sponge, porous elastomer used for impregnation stamp etc., non-woven fabric, felt, a bundle of fibers held together by resin, or may be formed of a porous material such as sintered metal, ceramic or polymer. This porous material (all the same in the embodiments hereinbelow) is deposited on the outer peripheral side of support member 11 by fitting, bonding by adhesives, or fusion bonding. In connection with this, in order to make sure deposition of ink leader portion 12 over the outer peripheral side of support member 11, fitting grooves or the like may be formed.

Writing part 13 is formed integrally with ink leader portion 12 covered by the same material as ink leader portion 12 over the lower part of support member 11. Though this part is inclined with an angle of less than 45 degrees with respect to the axial direction as is shown in FIG. 8, this may be flat, of course. The shape of this part should be designed as appropriate in conformity with the convenience of use for writing. Writing part 13 is one which renders wide lines, preferably having a line width of 2 mm or greater, more preferably having a line width of 3 mm or greater.

The aforementioned ink leader portion 12 has an ink leader shank part 12*a* that covers shank portion 11*b* of support member 11 but has the viewer portion 11*a* sides perpendicular to the shank, uncovered. Shank portion 11*b* and ink leader shank part 12*a* may be shaped so as to have a round or square cross section as appropriate.

Further, if the above viewer portion 11*a* is formed of a lens member (all the same in the embodiments hereinbelow) presenting a lens effect, it is possible to see magnified field of view through the viewer portion.

This pen element 10 of the first embodiment can be preferably applied as the pen elements of the writing implements of embodiments A to E shown in FIGS. 1 through 6, for example. It is of course possible to use the pen element 10 of the first embodiment as the pen element for thick lines of the writing implement F for thin and think lines of the embodiment shown in FIG. 7 (though the pen element configuration in FIG. 7 is slightly different from that of the first embodiment).

When normal handwriting from the left to right by the right hand is performed using one of writing implements A to F (shown in FIGS. 1 to 7) having this pen element 10 for thick lines, of the first embodiment, the right side of the pen point can be readily seen through viewer portion la (and shank portion 11*b*) located directly above writing part 13 with respect to the axial direction since support member 11 is configured of viewer portion 11*a* and shank portion 11*b* formed of transparent resin, glass or the like. Thus, the right end of the line can be distinguished readily.

This configuration contributes to remarkable improvement in handling performance when rules of a table are drawn on simili paper, when characters of a horizontally written article are traced by an high lighter pen etc., or when the pen is used in a relatively narrow space such as in the train, airplane and the like.

Next, other embodiments of the pen elements as a essential feature of the writing implement of the present invention will be described with reference to FIGS. 9 to 21. The pen elements of these embodiments shown in FIGS. 9 to 21 can be preferably applied as the pen elements of writing implements A to F shown in FIGS. 1 to 7, for example. Similarly to the above pen element 10 of the first embodiment, the right side of the pen tip can be readily seen with the help of the viewer portion of each, so as to allow the user to readily distinguish the right end of the drawn line.

Figure 9:
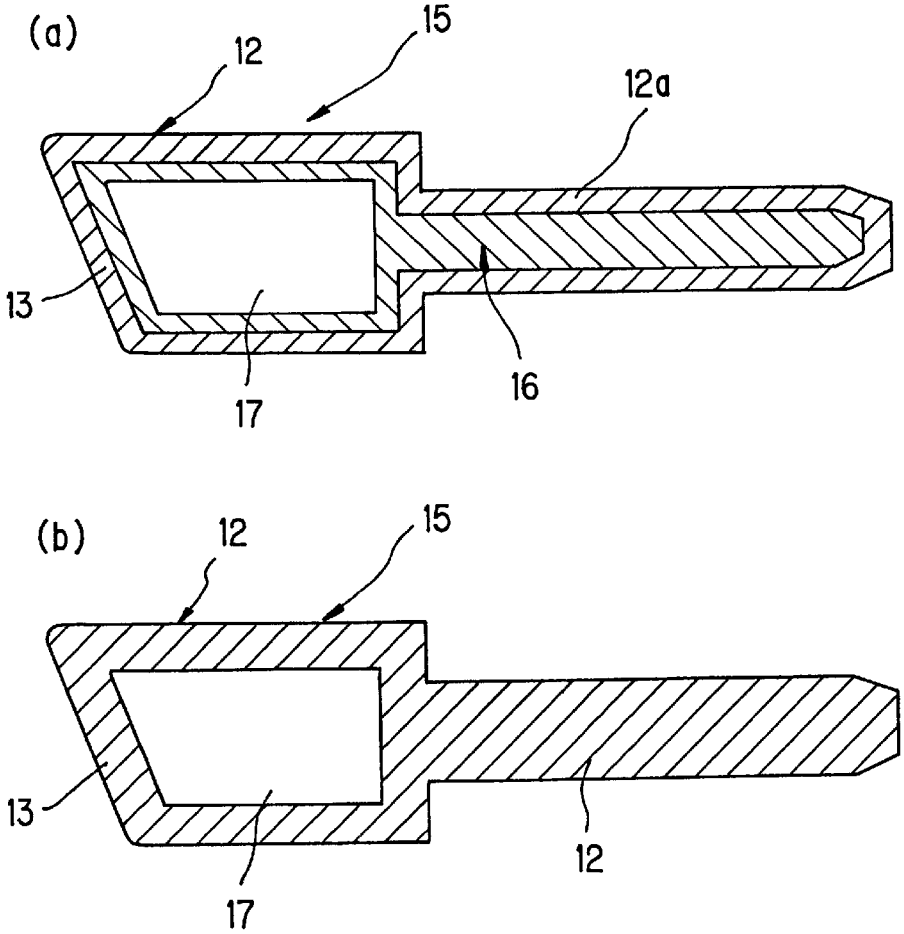
FIG. 9(*a*) is a sectional view showing the second embodiment of a pen element as an essential feature of the present invention, FIG. 9(*b*) is a sectional view of a variational example of (a).

FIG. 9(*a*) shows a pen element of the second embodiment. This pen element 15 of the second embodiment has almost the same configuration as the above pen element 10 of the first embodiment except in that the viewer portion of a support member 16 is formed with a hollow of frame-like window 17. Specifically, support member 16 is pierced forming window 17 which allows for a field of view in the writing direction.

The same components as those in the pen element of the first embodiment are allotted with the same reference numerals without any description. In this second embodiment, the view in the writing direction can be seen through the hollow of window 17, so that supporting member 16 is not necessarily made of a transparent resin. Further, as shown in FIG. 9(*b*), pen element 15 may be of a thick, one-piece structure of ink leader portion 12 and writing part 13 made up of a porous material without having any support member 16 and be formed with a hollow, frame-like window 17 for the viewer portion.

Figure 10:
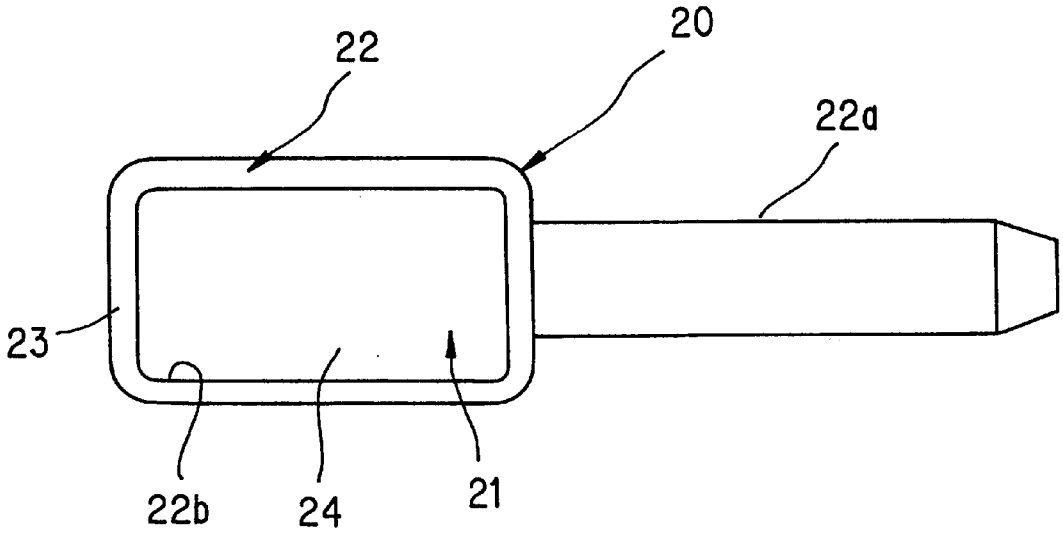
FIG. 10(*a*) is a front view showing the third embodiment of a pen element as an essential feature of the present invention, FIG. 10(*b*) is a sectional view of (a)
Figure 10:
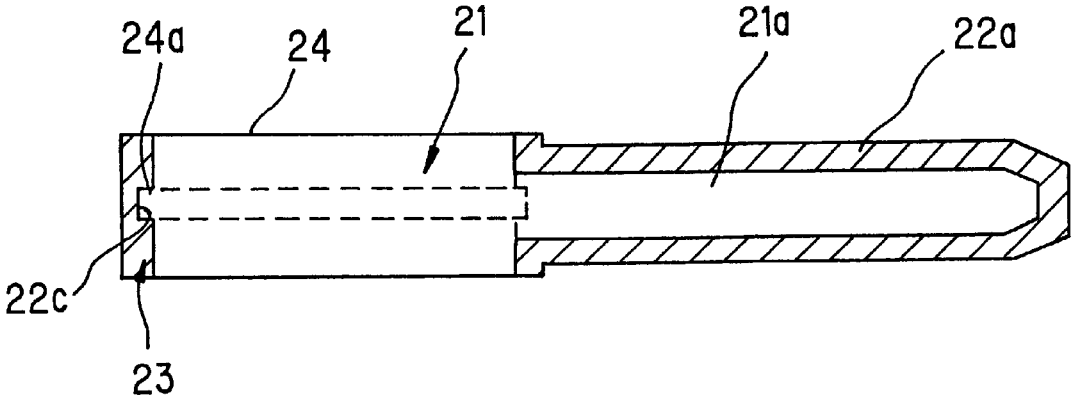

FIGS. 10(*a*) and 10(*b*) show a pen element of the third embodiment. In this pen element 20 of the third embodiment, a support member 21 is made up of resin, glass or the like having the same characteristic as that in the first embodiment. An ink leader portion 22 and writing part 23 are made up of a porous material as in the first embodiment. A shank portion 21*a* of support member 21 is fitted into the bore of a shank portion 22*a* of ink leader portion 22 while a rib 24*a* formed on the periphery of a viewer portion 24 is mated with a grooved portion 22*c* formed on the inner side of a frame-like portion 22*b* of ink leader portion 22 so that ink leader portion 22 and writing part 23 is integrally fixed to support member 21. Here, this configuration can also be formed by double molding.

Figure 11:
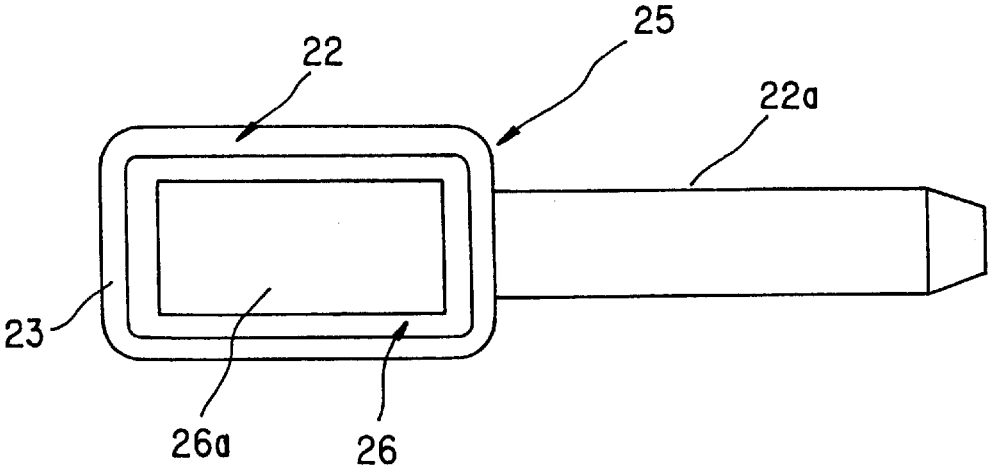
FIG. 11 is a front view showing the fourth embodiment of a pen element as an essential feature of the present invention.

FIG. 11 shows a pen element of the fourth embodiment. This pen element 25 of the third embodiment has the almost the same configuration as that of the fourth embodiment, except in that the viewer portion of a support member 26 is formed with a frame-like window 17 as a hollow, which allows observation of the view in the writing direction. Here, the same components as those of the pen element of the third embodiment are allotted with the same reference numerals without description.

Figure 12:
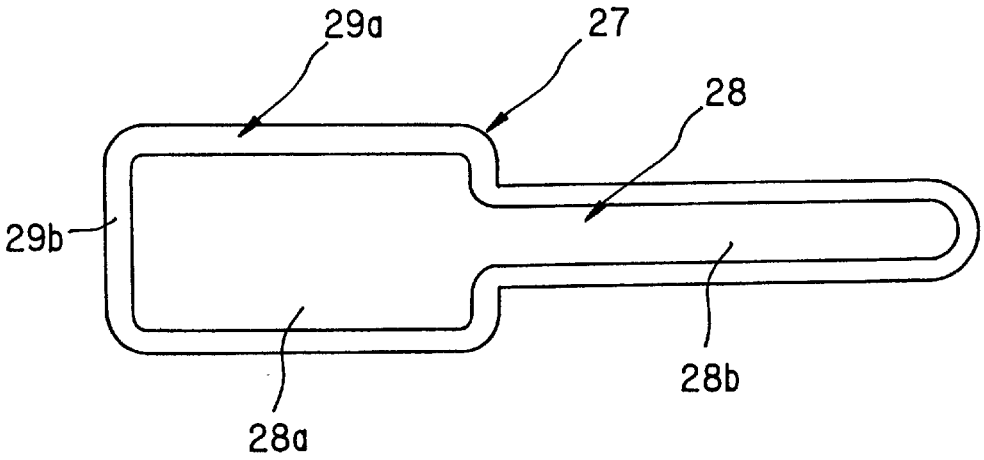
FIG. 12 is a front view showing the fifth embodiment of a pen element as an essential feature of the present invention.

FIG. 12 shows a pen element of the fifth embodiment. This pen element 27 of the fifth embodiment comprises a support member 28 and an integral part of an ink leader portion 29*a* and writing part 29*b*, covering the outer periphery of support member 28. In this case, the whole configuration of a viewer portion 28*a* and shank 28*b* has a planiform plate-like shape.

Figure 13:
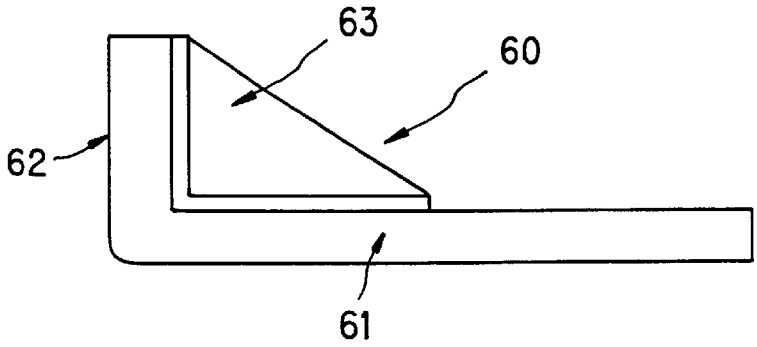
FIG. 13 is a front view showing the sixth embodiment of a pen element as an essential feature of the present invention.

FIG. 13 shows a pen element of the sixth embodiment. This pen element 60 of the sixth embodiment has an approximately rectangular structure (without its shape specified). This pen element 60 is formed of a one-piece porous member of an ink leader portion 61 and writing part 62 formed in an approximate L-shape. A transparent support member 63 forming a viewer portion is fixed at the inside corner so as to reinforce ink leader portion 61 and writing part 62.

Figure 14:
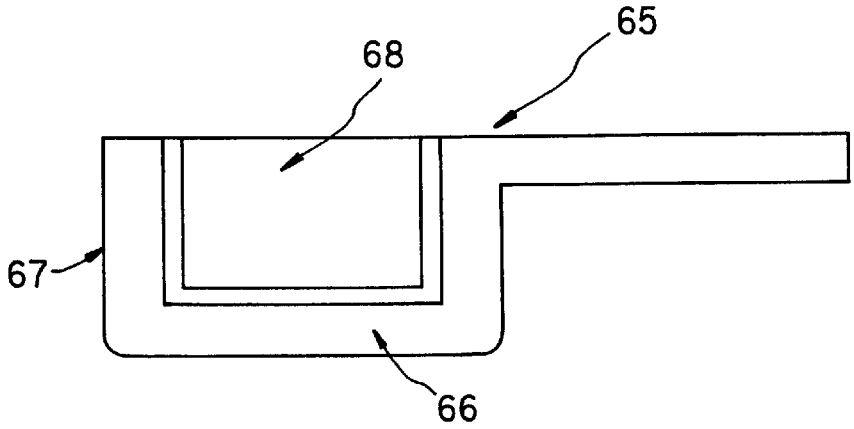
FIG. 14 is a front view showing the seventh embodiment of a pen element as an essential feature of the present invention.

FIG. 14 shows a pen element of the seventh embodiment. This pen element 65 of seventh embodiment is formed of a one-piece body porous member of an ink leader portion 66 and writing part 67 formed in an approximate U-shape. A transparent support member 68 forming a viewer portion is fixed at the inside hollow so as to reinforce ink leader portion 66 and writing part 67.

Figure 15:
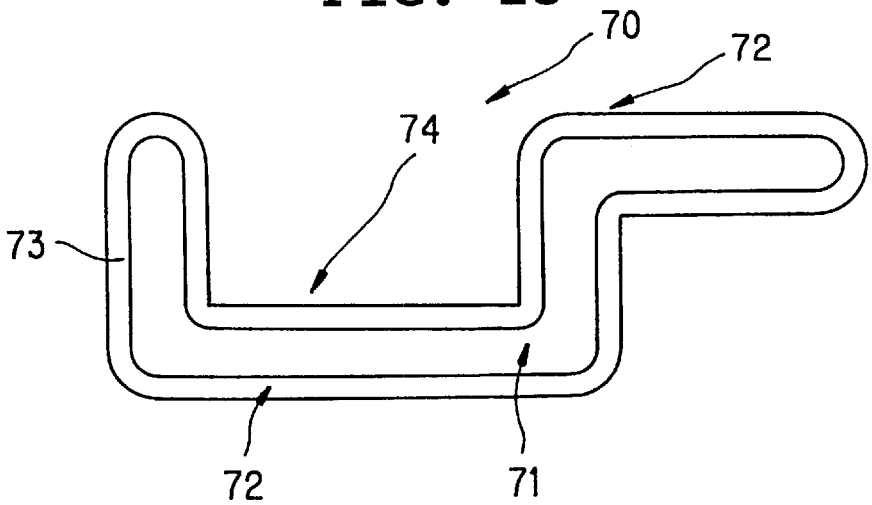
FIG. 15 is a front view showing the eighth embodiment of a pen element as an essential feature of the present invention.

FIG. 15 shows a pen element of the eighth embodiment. This pen element 70 of the eighth embodiment comprises an approximately U-shaped support member 71 and an one-piece body porous member of an ink leader portion 72 and writing part 73, covering the outer periphery of support member 71. The hollow defined by this approximately U-shaped portion forms a viewer portion 74.

Figure 16:
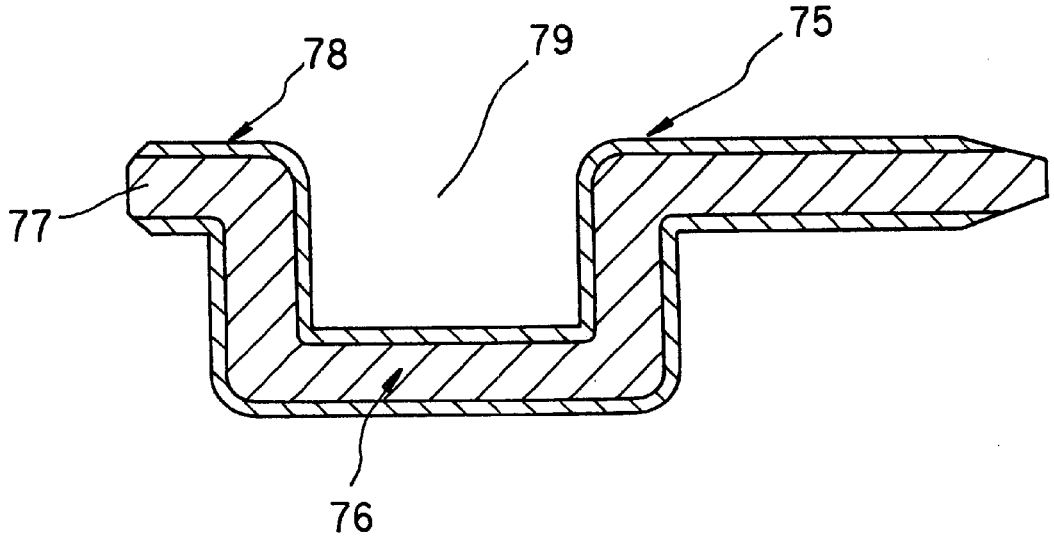
FIG. 16 is a front view showing the ninth embodiment of a pen element as an essential feature of the present invention.

FIG. 16 shows a pen element of the ninth embodiment. This pen element 75 of the ninth embodiment comprises an approximately U-shaped porous member of an ink leader portion 76 and writing part 77 and a cladding 78 of a hard-resin or metal pipe covering its outer periphery with both ends of the porous member uncovered. The hollow defined by this approximately U-shaped portion forms a viewer portion 79.

Figure 17:
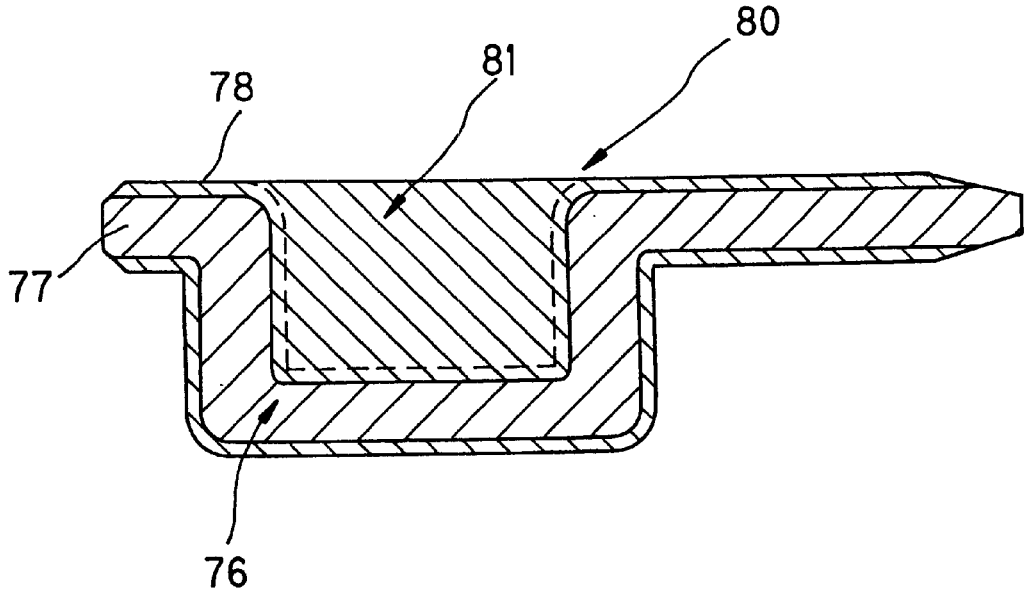
FIG. 17 is a front view showing the tenth embodiment of a pen element as an essential feature of the present invention.

FIG. 17 shows a pen element of the tenth embodiment. This pen element 80 of the tenth embodiment has the almost the same configuration as that of the ninth embodiment, except in that a transparent support member 81 for observation of the view is integrally formed in the approximately U-shaped hollow in order to reinforce ink leader portion 76 and writing part 77. Here, the same components as those in the ninth embodiment are allotted with the same reference numerals without any description.

Figure 18:
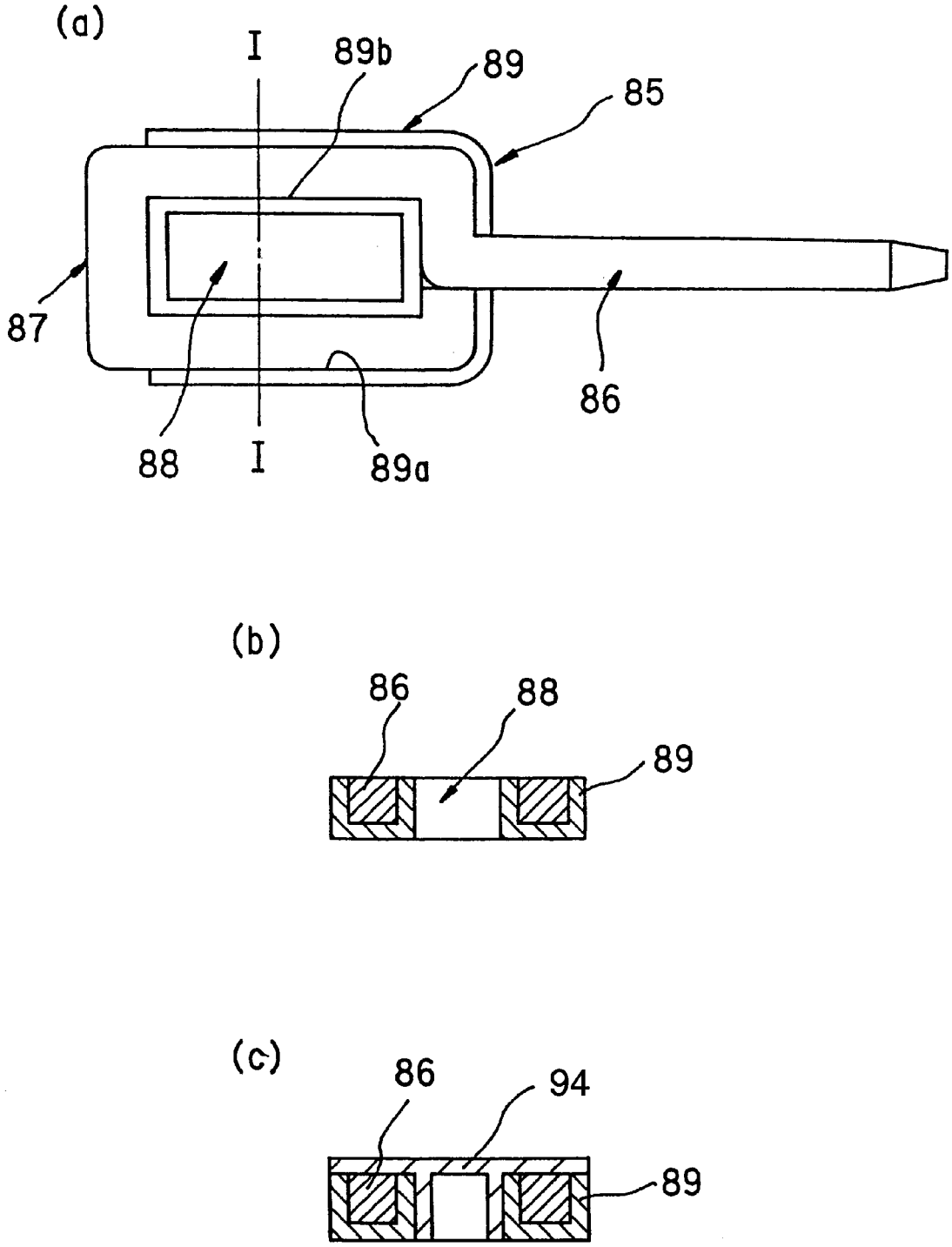
FIG. 18(*a*) is a front view showing the eleventh embodiment of a pen element as an essential feature of the present invention, FIG. 18(*b*) is a sectional view of (a) cut along I—I line.

FIGS. 18(*a*) to 18(*c*) show a pen element of the eleventh embodiment. This pen element 85 of the eleventh embodiment is a porous member which is formed in an approximately rectangular form with a shaft-like ink leader portion 86 and fixed inside outer and inner frames 89*a* and 89*b* of a support member 89 having a window 88 forming an rectangular viewer portion with its writing part 87 exposed. A cover member 94 made up of a transparent material is fixed to support member 89. Here, cover member 94 may be opaque with a window as a hollow pierced therein.

Figure 19:
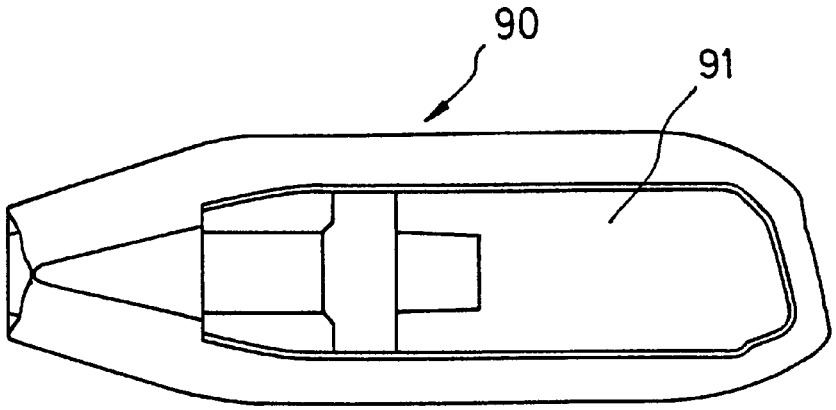
FIG. 19 is a front view showing the twelfth embodiment of a pen element as an essential feature of the present invention.
Figure 20:
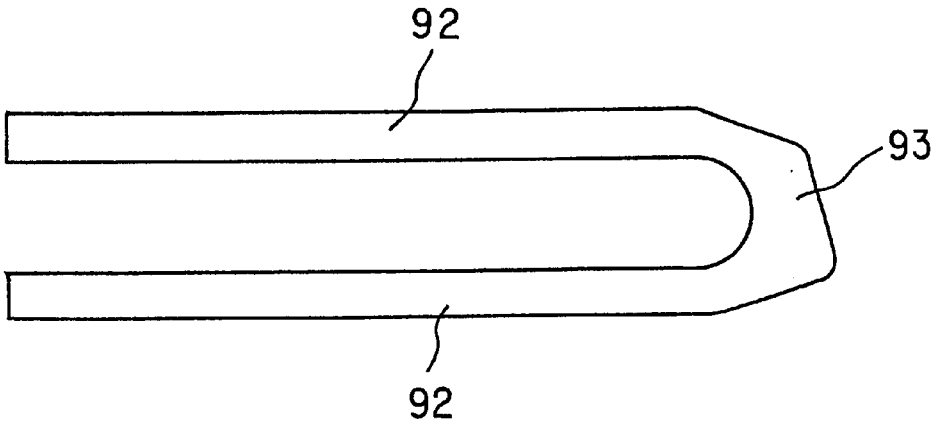
FIG. 20 is a front view showing an integral configuration of an ink leader portion and a writing part used for the pen element of the twelfth embodiment.
Figure 21:
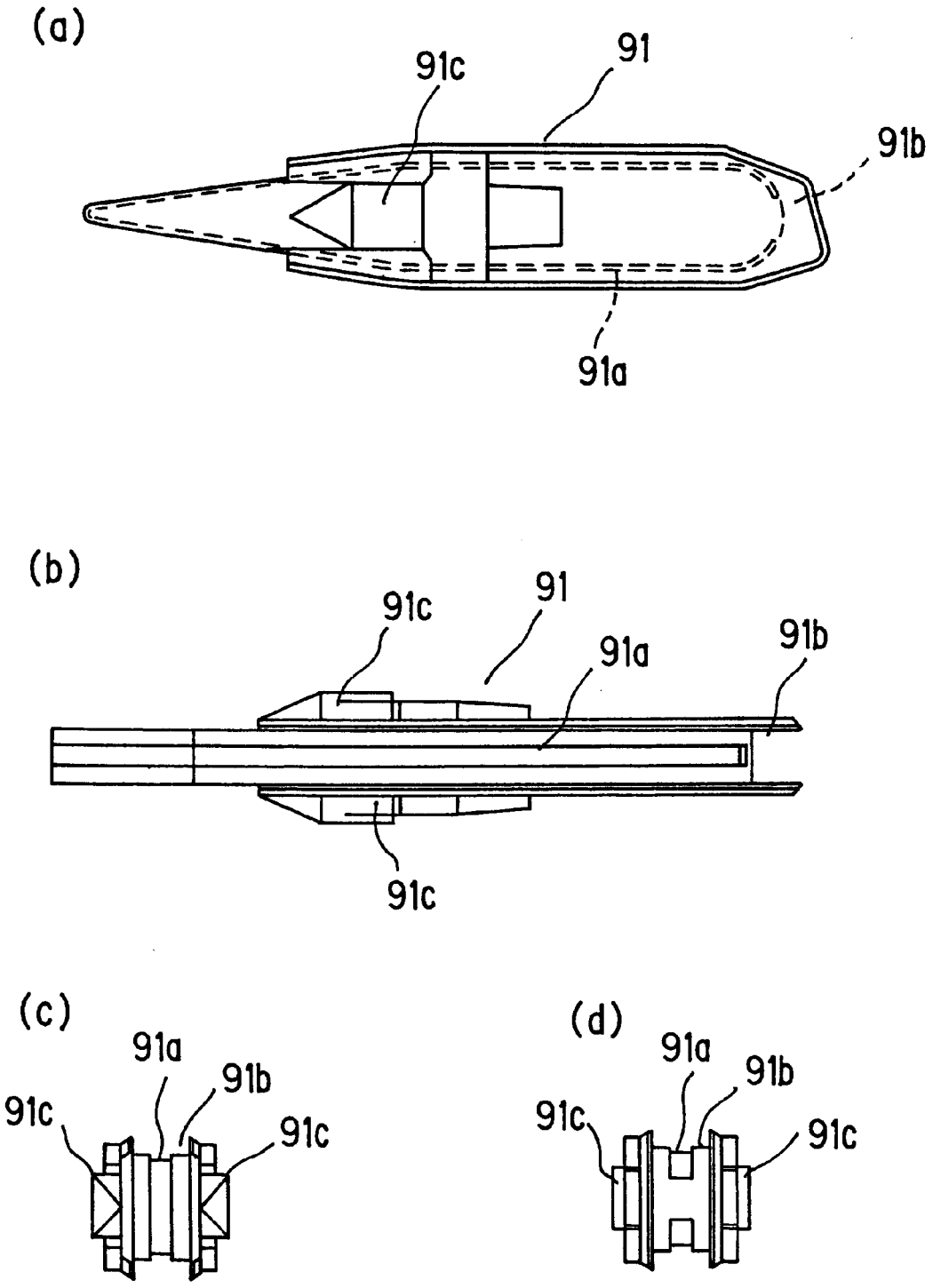
FIGS. 21(*a*) to (*d*) are plan, front, left-side and right-side views, respectively, showing a support member used for the pen element of the twelfth embodiment.
Figure 22:
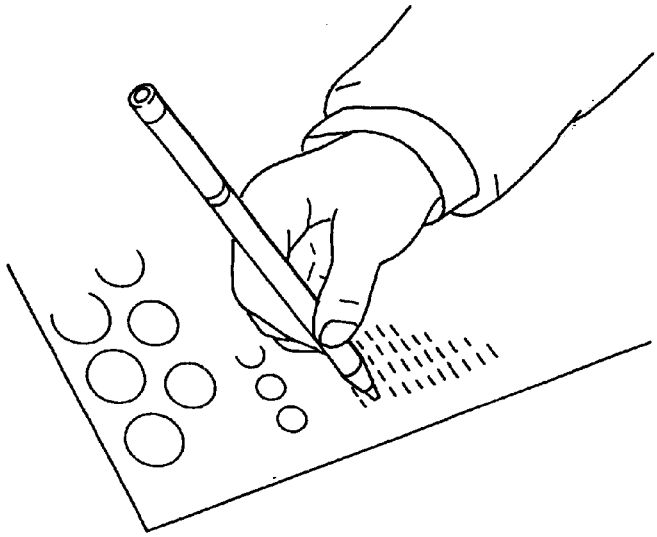
FIG. 22(*a*) is a perspective view showing a case where a pen is held in an unnatural manner.
Figure 22:
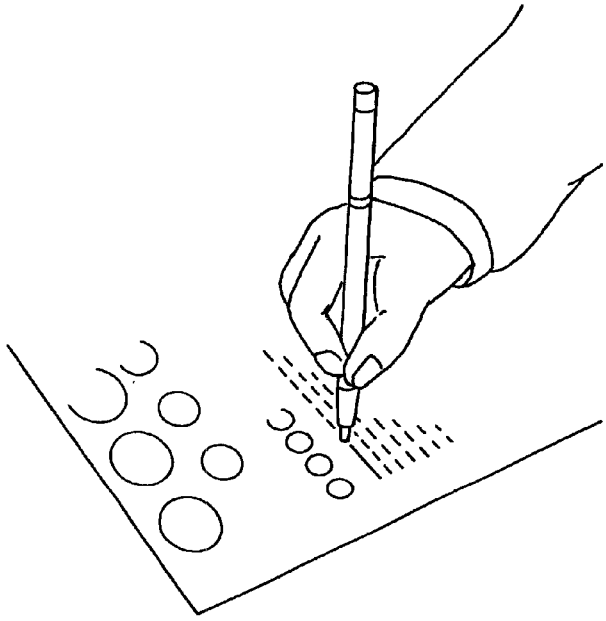
Figure 23:
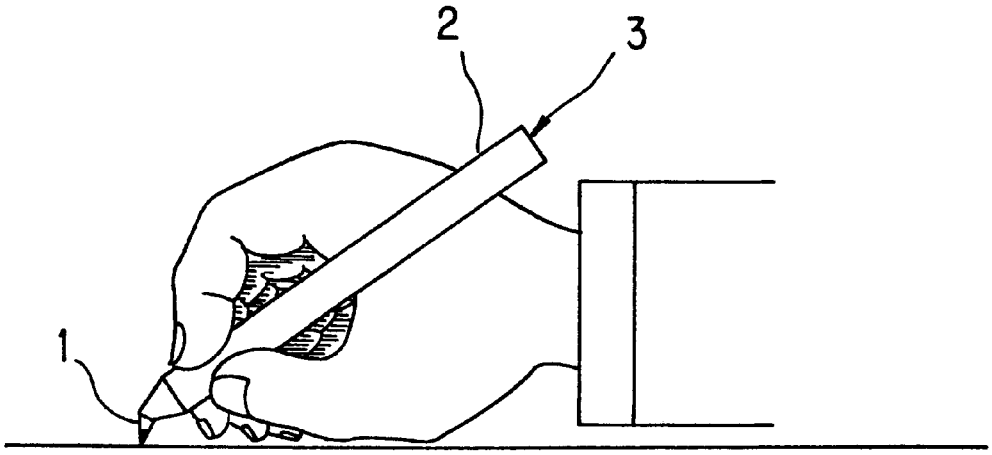
FIG. 23 is a drawing showing an example where a conventional writing implement is being used.

FIGS. 19 to 21 show a pen element of the twelfth embodiment. This pen element of the twelfth embodiment is shown as the pen element of the above-described writing implement of embodiment F (FIG. 7).

This pen element 90 of the twelfth embodiment comprises a transparent support member 91 and an approximately U-shaped one-piece porous member of an ink leader portion 92 and writing part 93, covering the outer periphery of support member 91.

As shown in FIGS. 21(*a*) to 21(*c*), support member 91 is formed on its outer peripheral side with a fitting groove 91*b* having a stepped portion 91*a* for fitting the approximately U-shaped porous member of ink leader portion 92 and writing part 93. Formed on both the side faces of the support member are a pair of fitting projections 91*c* and 91*c*, to be fitted to a fitting hole 165*a* of a rear barrel 165 of writing implement F shown in FIG. 7.

Since support member 91 of pen element 90 of this embodiment is made of transparent resin etc., support member 91 itself forms a viewer portion allowing observation of the view in the writing direction.

Though a variety of embodiments of pen elements have been illustrated as above, the pen element as the essence of the present invention should not be limited to the above embodiments. That is, the features of the above pen elements of the first to twelfth embodiments (FIGS. 8 through 21) may be combined appropriately while the configurations other than the pen elements as the essence of the present invention are not particularly limited.

Further, fluorescent color additives such as Basic Violet 11, Basic Yellow 40 may be blended in the ink for high lighter pens and the like so as to further improve the visibility. It should be noted that the compositions of ink used for the writing implement of the present invention are not particularly limited.

Moreover, liquid cosmetics, medical liquids, painting liquids, correction fluid, or the like may be used instead of ink with an applicator suitable for the liquid as the writing part made of the porous member.

With the thus configured writing implements of all the embodiments of the present invention, since a viewer portion is provided directly above with resect to the axial direction of the writing part of the pen element, so as to allow observation of the view in the writing direction, the right side of the pen point can be readily seen and hence the right end of the drawn line can be easily distinguished even when a line with a large width is drawn from the left to right by the right hand. Thus, this configuration contributes to remarkable improvement in handling performance when rules of a table are drawn on simili paper, when characters on horizontally written lines of an article are traced by an high lighter pen etc., or when the pen is used in a relatively narrow space such as in the train, airplane and the like.

INDUSTRIAL APPLICABILITY

The configuration and operation of the present invention have been described heretofore. That is, since a viewer portion is provided directly above with resect to the axial direction of the writing part of the pen element, the right side can be readily observed and hence the right end of the drawn line can be easily distinguished when writing is performed from the left to right by the right hand using a writing implement for thick lines. This configuration contributes to remarkable improvement in handling performance, especially when rules of a table are drawn on simili paper, when characters of a horizontally written article are traced by an high lighter pen etc. Further this configuration is effective in use at a relative narrow space such as in the train, airplane and the like.

What is claimed is:

1. A writing implement having a pen element that feeds and retains ink from the writing implement body, characterized in that the pen element comprises: a porous ink leader portion; a writing part delivering ink from the ink leader portion; and a viewer portion disposed directly above with respect to the axial direction of the writing part allowing observation of the view in the writing direction; and wherein the ink leader portion is disposed about and supported by the viewer portion to permit observation of the writing direction.

2. The writing implement according to claim 1 wherein the writing part of the pen element renders drawn lines of 2 mm or wider.

3. The writing implement according to claim 2, wherein the ink leader portion and writing part of the pen element is formed of a one-piece porous member.

4. The writing implement according to claim 2, wherein the pen element further comprises a support member for supporting the ink leader portion and writing part, and at least part of the support member allows observation of the view in the writing direction, providing the function of the viewer portion.

5. The writing implement according to claim 1 wherein the ink leader portion and writing part of the pen element is formed of a one-piece porous member.

6. The writing implement according to claim 1 wherein the pen element further comprises a support member for supporting the ink leader portion and writing part, and at least part of the support member allows observation of the view in the writing direction, providing the function of the viewer portion.

7. The writing implement according to claim 6, wherein the viewer portion of the support member is a transparent support member or a window as a hollow.

8. The writing implement according to claim 1 wherein the viewer portion is formed of a lens member.

9. The writing implement according to claim 1 wherein the ink contains a fluorescent color additive.

10. A writing implement having a pen element that feeds and retains ink from the writing implement body, characterized in that the pen element comprises: an ink leader portion; a writing part delivering ink from the ink leader portion; and a viewer portion disposed directly above with respect to the axial direction of the writing part allowing observation of the view in the writing direction, wherein the viewer portion of the pen element has the ink leader portion on one or both sides with respect to the width and the writing part for delivering ink from the ink leader portion is arranged below the viewer portion.

11. A writing implement having a pen element that feeds and retains ink from the writing implement body, characterized in that the pen element comprises: an ink leader portion; a writing part delivering ink from the ink leader portion; and a viewer portion disposed directly above with respect to the axial direction of the writing part allowing observation of the view in the writing direction, wherein the writing part of the pen element renders drawn lines of 2 mm or wider, wherein the viewer portion of the pen element has the ink leader portion on one or both sides with respect to the width and the writing part for delivering ink from the ink leader portion is arranged below the viewer portion.

* * * * *